US007332856B2

(12) United States Patent
Kijima et al.

(10) Patent No.: US 7,332,856 B2
(45) Date of Patent: Feb. 19, 2008

(54) IMAGE DISPLAY DEVICE

(75) Inventors: Yuuichi Kijima, Chosei (JP); Shigemi Hirasawa, Chiba (JP); Kenji Kato, Mobara (JP); Akira Hatori, Chiba (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 274 days.

(21) Appl. No.: 11/255,148

(22) Filed: Oct. 21, 2005

(65) Prior Publication Data

US 2006/0208627 A1 Sep. 21, 2006

(30) Foreign Application Priority Data

Oct. 22, 2004 (JP) ..... 2004-307728

(51) Int. Cl.
*H01J 1/62* (2006.01)

(52) U.S. Cl. ..... 313/495; 313/292
(58) Field of Classification Search ..... 313/495, 313/496, 238, 292
See application file for complete search history.

(56) References Cited

U.S. PATENT DOCUMENTS 5,734,224 A 3/1998 Tagawa et al.

FOREIGN PATENT DOCUMENTS

| | | |
|---|---|---|
| JP | 07-230776 | 8/1995 |
| JP | 07-302540 | 11/1995 |
| JP | 2004-182959 | 7/2004 |

*Primary Examiner*—Vip Patel
(74) *Attorney, Agent, or Firm*—Antonelli, Terry, Stout & Kraus, LLP.

(57) ABSTRACT

An image display device has a front substrate having an anode and phosphors, a rear substrate having electron sources and opposing the front substrate with a specified spacing therebetween, a support member which is sandwiched between the front and rear substrates, surrounds a display region, and maintains the specified spacing, and plural spacing-maintaining members which are sandwiched between the front and rear substrates in the display region, and are fixed at at least one of end faces of each of the spacing-maintaining members to a corresponding one of the front and rear substrates. Both end faces of the support member is hermetically sealed to the rear and front substrates, respectively. A height of the spacing-maintaining members is greater than that of the support member.

14 Claims, 8 Drawing Sheets

FIG. 12

EXAMPLES OF COMBINATIONS OF SEALING MEMBERS

| EXAMPLES | SEALING MEMBER 10a | SEALING MEMBER 10b |
|---|---|---|
| 1 | CRYSTALLIZED GLASS FRIT | NONCRYSTALLINE GLASS FRIT |
| 2 | NONCRYSTALLINE GLASS FRIT HAVING A HIGH SOFTENING POINT | NONCRYSTALLINE GLASS FRIT HAVING A LOW SOFTENING POINT |
| 3 | NONCRYSTALLINE GLASS FRIT | SILICONE ADHESIVE |
| 4 | CRYSTALLIZED GLASS FRIT | SILICONE ADHESIVE |

IMAGE DISPLAY DEVICE

CLAIM OF PRIORITY

The present application claims priority from Japanese application serial no. 2004-307728, filed on Oct. 22, 2004, the content of which is hereby incorporated by reference into this application.

BACKGROUND OF THE INVENTION

The present invention relates to an image display device which utilizes emission of electrons into a vacuum produced between a front substrate and a rear substrate, and in particular to a configuration of a combination of a support-member and spacing-maintaining members which support and seal the front and rear substrates with a desired spacing therebetween.

Conventionally, color cathode ray tubes have been widely used as display devices excellent in producing high-brightness high-definition display devices. However, as the image quality in information processing equipment and TV broadcasts has been improved in recent years, the demand has been becoming stronger for flat panel display devices capable of realizing lighter weight and thinner profile in addition to the performance of high brightness and high definition. As their typical examples, liquid crystal display devices and plasma display devices have been put to practical use.

Further, various types of flat panel type display devices are under development for practical use. Especially as display devices capable of realizing higher brightness, image display devices are being developed which utilize emission of electrons into a vacuum from an electron source (for example, they are ones called electron-emission type display devices, field emission type display devices or FEDs (Field-Emission Displays). Organic electroluminescent (EL) display devices are also being developed which feature low power consumption.

Among the electron-emission type display devices of such flat panel type display devices, known are one employing an electron-emitting structure invented by C. A. Spindt et al.; one employing an electron-emitting structure of the metal-insulator-metal (MIM) type; one employing an electron-emitting structure utilizing an electron emission phenomenon due to the tunnel effect in the quantum theory (this electron-emitting structure is sometimes called the surface conduction type electron source); and one employing an electron-emitting structure utilizing an electron emission phenomenon exhibited by a diamond film, a graphite film or carbon nanotubes.

Among these flat panel type display devices, an image display device of the field-emission type has a rear substrate having, on an inner surface thereof, cathode wirings provided with field-emission type electron sources and control electrodes, and a front substrate having anodes and phosphors on an inner surface thereof opposing the rear substrate. The front and rear substrates are attached together with a support frame sandwiched between their peripheries, and are hermetically sealed to form a panel. The airtight space within the panel is exhausted to and maintained at a pressure lower than the atmospheric pressure or to a vacuum. The control electrodes are disposed such that the direction of extension of the control electrodes intersects the direction of extension of the cathode wirings, with an insulating layer or an insulating spacing interposed between the control electrodes and the cathode wirings. The control electrodes are provided with one or more apertures for passing electrons from the electron sources disposed on the cathode wirings therethrough in each of pixels. Further, to maintain the spacing between the rear and front substrates at a desired value, spacing-maintaining members are interposed between the rear and front substrates. The spacing-maintaining members are formed of thin plates of glass or ceramics, for example, and are stood upright and clear of the pixels.

FIG. 9 is a cross-sectional view of a major portion of an image display device serving as an example of conventional flat panel type display devices of this kind. This image display device comprises: a rear plate (a rear substrate) 2 having a plurality of electron-emissive elements 5 thereon; a front plate (a front substrate) 1 disposed to oppose the rear plate 2 and having thereon image-forming members 6 which form images by radiation of electron rays emitted from electron-emissive elements 5; a support frame 3 which is sandwiched between the front plate 1 and the rear plate 2, and supports peripheral portions of the front plate 1 and the rear plate 2; and spacers (spacing-maintaining members) 4 disposed between the front plate 1 and the rear plate 2 so as to serve as props. Those plural constituent members are attached together to form an airtight structure by using glass frit.

In this case, as shown in FIG. 10 depicting the enlarged detailed cross-sectional view of its major portion, a glass frit 10 for fixing the support frame 3 is coated on the rear plate 2 (or the front plate 1), glass frits 11 for fixing spacers 4 are coated on the rear plate 2 (or the front plate 1), and the thickness of the glass frit 10 after being subjected to a preparatory firing is selected to be greater than that of the glass frit 11 after being subjected to a preparatory firing. That is to say, the support frame 3 and the spacers 4 are fixed, respectively, by satisfying the relationship of $H1>H2$, where H1 is the thickness of the glass frit 10 for fixing the support frame 3 after being subjected to the preparatory firing, and H2 is the thickness of the glass frit 11 for fixing the spacers 4 after being subjected to the preparatory firing. By employing this method, breakage of the spacers 4 or the electron-emissive elements 5 is prevented. This kind of an image display device is disclosed in Japanese Patent No. 3,129,909 (Japanese Patent Application Laid-Open Publication No. Hei 7-302,540).

Further, FIG. 11 is a cross-sectional view of a major portion of an image display device for explaining another example of image display devices. In this image display device, the length of spacers 4 is selected to be smaller than a spacing between a rear plate 2 and a front plate 1, which is established by a support frame 3, and one end of each of the spacers 4 is fixed to the rear plate 2 (or the front plate 1) by using adhesive members (glass frits) 11. That is to say, the support frame 3 and the spacers 4 are fixed, respectively, by satisfying the relationship of $L1>L2$, where L1 is the height of the support frame 3, and L2 is the height of the spacers 4. This configuration improves the strength withstanding atmospheric pressure and resistance to shock. This kind of an image display device is disclosed in Japanese Patent No. 3,241,219 (Japanese Patent Application Laid-Open Publication No. Hei 7-230,776, which corresponds to U.S. Pat. No. 5,734,224).

SUMMARY OF THE INVENTION

There has been a problem with the image display device disclosed in the above-mentioned Japanese Patent No. 3,129,909 (Japanese Patent Application Laid-Open Publication No. Hei 7-302,540). Since the thickness H1 of the coated glass frit 10 for fixing the support frame 3 after being subjected to a preparatory firing is selected to be greater than the thickness H2 of the coated glass frit 11 for fixing the spacers 4 after being subjected to a preparatory firing, the spacers 4 do not touch the glass frits 11 until the glass frit 10 is melted for assembling the display panel, and consequently, the spacers 4 are easily tilted and as a result errors occur easily in aligning of the front and rear plates.

Also there has been a problem with the image display device disclosed in the above-mentioned Japanese Patent No. 3,241,219 (Japanese Patent Application Laid-Open Publication No. Hei 7-230,776, which corresponds to U.S. Pat. No. 5,734,224). Since the front and rear plates 1, 2 are bonded together with the height L1 of the support frame 3 being greater than the height L2 of the spacers 4, the spacing of the front and rear plates 1,2 is determined by the height L1 of the support frame 3. Consequently, the force of atmospheric pressure is not applied uniformly all of the spacers 4, and it was not possible to secure safety from possible danger caused by atmospheric pressure, such as resistance to implosion.

In the flat panel type display devices such as FEDs including the devices disclosed in Japanese Patent No. 3,129,909 (Japanese Patent Application Laid-Open Publication No. Hei 7-302,540) and Japanese Patent No. 3,241,219 (Japanese Patent Application Laid-Open Publication No. Hei 7-230,776, which corresponds to U.S. Pat. No. 5,734,224), it is very difficult to fix the spacers 4 disposed in a display area between the front plate 1 and the rear substrate 2, without occurrences of alignment errors or tilts, there is also a problem in that the spacers 4 are broken, and the broken spacers 4 damage electron-emissive elements 5 and electrodes, and there is also a danger that the addition of the process of bonding the spacers 4 causes cracks and air leakage in the hermetically sealed portions. Therefore there have been demands for solutions to the above problems.

Further, the spacers 4, the front plate 1 and the rear plate 2 is generally bonded by using the glass frits 11 of the same material as that of the glass frit 10 used for hermetic sealing.

In the case of crystallized glass frit, crystallization proceeds during a heat treatment of a long period of time, physical properties such as a coefficient of thermal expansion change, and therefore there is a danger that cracks occur, or hermetic sealing is broken, resulting in air leakage.

In the case of noncrystalline glass frit, it is softened by a heat treatment for baking a display panel during evacuation of the display panel, this softening causes the already fixed spacers to shift or tilt, and further there is a danger that the spacers might be broken.

Therefore the present invention has been made to solve the above-explained problems with the conventional image display devices, and it is an object of the present invention to provide an image display device capable of producing a high-quality image display by reducing the amount of alignment errors in sealing of the front and rear planes.

It is another object of the present invention to provide an image display device capable of producing a highly reliable image display by dispersing the force of atmospheric pressure applied approximately uniformly over the entirety of the display panel comprised of the front and rear substrates, the support member, and the spacing-maintaining members, and thereby preventing tilt and breakage of the spacing-maintaining members.

The following will explain the summary of the representative ones of the inventions disclosed in this specification.

(1) An image display device comprising: a front substrate having an anode and phosphors on an inner surface thereof; a rear substrate having a plurality of electron sources on an inner surface thereof, and disposed to oppose said front substrate with a specified spacing between said front and rear substrates; a support member which is sandwiched between said front and rear substrates, surrounds a display region formed between said front and rear substrates, and maintains said specified spacing; and a plurality of spacing-maintaining members which are sandwiched between said front and rear substrates in said display region, and are fixed at at least one of end faces of each of said plurality of spacing-maintaining members to a corresponding one of said front and rear substrates via a fixing member, wherein one end face of said support member is hermetically sealed to said rear substrate via a first sealing member, and another end face of said support member is hermetically sealed to said front substrate via a second sealing member; and wherein a height of said spacing-maintaining members is greater than a height of said support member.

(2) An image display device according to (1), wherein a difference between the height of said spacing-maintaining members and the height of said support member is in a range of from 10 μm to 400 μm.

(3) An image display device according to (2), wherein a difference between the height of said spacing-maintaining members and the height of said support member is in a range of from 10 μm to 300 μm.

(4) An image display device according to (1), wherein a thickness of said first sealing member is different from a thickness of said second sealing member.

(5) An image display device according to (4), wherein the thickness of said first sealing member is greater than the thickness of said second sealing member.

(6) An image display device according to (5), wherein the thickness of said first sealing member is greater by a value in a range of from 10 μm to 190 μm than the thickness of said second sealing member.

(7) An image display device according to (1), wherein said first and second sealing members differ in material composition from each other so that said first and second sealing members differ from each other in viscosity vs. temperature characteristics.

(8) An image display device according to (1), wherein said first sealing member is comprised of crystallized glass frit, and said second sealing member is comprised of noncrystalline glass frit.

(9) An image display device according to (1), wherein said first sealing member is comprised of first noncrystalline glass frit, and said second sealing member is comprised of second noncrystalline glass frit having a softening point lower than a softening point of said first noncrystalline glass frit.

(10) An image display device according to (1), wherein said first sealing member is comprised of noncrystalline glass frit, and said second sealing member is comprised of silicone adhesive.

(11) An image display device according to (10), wherein said silicone adhesive is a silicone resin comprising at least phenylheptamethylcyclotetrasiloxane and 2,6-cis-diphenylhexamethylcyclotetrasiloxane.

(12) An image display device according to (1), wherein said first sealing member is comprised of crystallized glass frit, and said second sealing member is comprised of silicone adhesive.

(13) An image display device according to (12), wherein said silicone adhesive is a silicone resin comprising at least phenylheptamethylcyclotetrasiloxane and 2,6-cis-diphenylhexamethylcyclotetrasiloxane.

(14) An image display device according to (1), wherein one end face of each of said plurality of spacing-maintaining members is fixed to said rear substrate via said fixing member of a first kind, another end face of each of said plurality of spacing-maintaining members is fixed to said front substrate via said fixing member of a second kind, and said fixing member of said first kind and said fixing member of said second kind differ in material composition from each other so that said fixing members of said first and second kinds differ from each other in viscosity vs. temperature characteristics.

Incidentally, it is needless to say that the present invention is not limited to the above-described configurations or the configurations of the embodiments to be described subsequently, but various changes and modifications can be made without departing from the true spirit and scope of the present invention.

In the present invention, by selecting the height of the spacing-maintaining members to be greater than the height of the support member, the spacing between the front and rear substrates is determined by the height of the spacing-maintaining members, resulting in reduction of the amount of alignment errors in sealing of the support member disposed between the front and rear substrates, therefore the spacing between the front and rear substrates is controlled to be held uniform with high precision, and consequently, the present invention provides extremely great advantages such as the realization of producing a high-quality image display.

Further, in the present invention, the rear substrate and one end face of the support member are bonded together hermetically with a first sealing member interposed therebetween, and the front substrate and the other end face of the support member are bonded together hermetically with a second sealing member interposed therebetween, therefore the spacing between the front and rear substrates is held securely, and at the same time damage to the spacing-maintaining members and attendant damage to electrodes and others can be prevented. Consequently, the present invention provides extremely great advantages such as the realization of producing a highly reliable image display.

Further, in the present invention, since the force of atmospheric pressure is dispersed approximately uniformly over the entire area of the display panel comprised of the front and rear substrates, the support member, and the spacing-maintaining members, the spacing-maintaining members are prevented from being tilted and others, thereby improving greatly the safety from possible danger caused by atmospheric pressure, such as resistance to implosion. Consequently, the present invention provides the present invention provides the extremely great advantages such as the realization of producing a highly reliable image display.

BRIEF DESCRIPTION OF THE DRAWINGS

In the accompanying drawings, in which like reference numerals designate similar components throughout the figures, and in which:

FIG. 12 is a table listing different combinations of sealing members.

DETAILED DESCRIPTION OF THE PREFERRED EMBODIMENTS

In the following the concrete embodiments of the present invention will be explained in detail by reference to the drawings.

Embodiment 1

Figure 1:
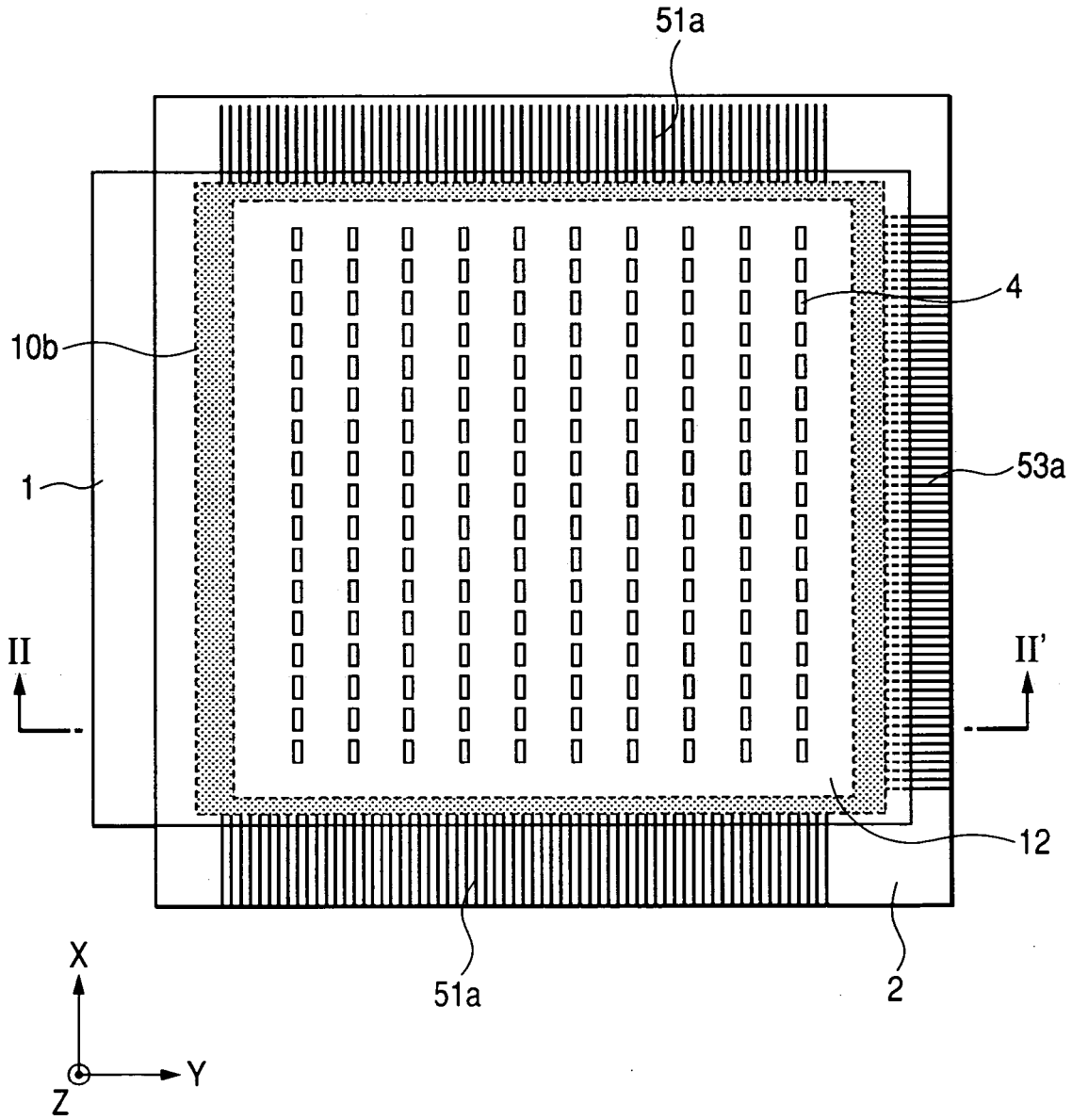
FIG. 1 is a schematic plan view illustrating a configuration of Embodiment 1 of the image display device in accordance with the present invention.
Figure 2:
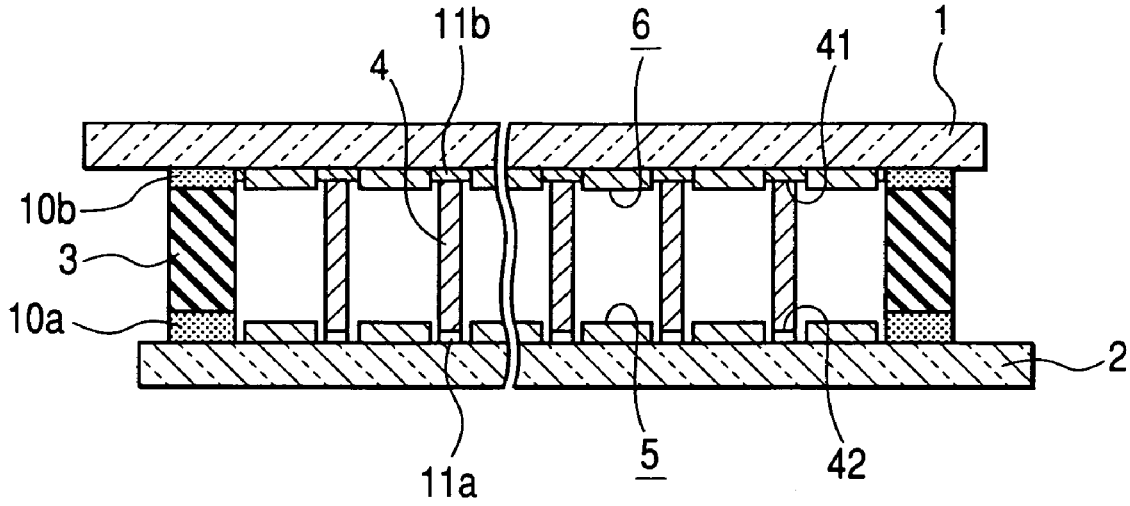
FIG. 2 is an enlarged cross-sectional view of an major portion of the image display device of FIG. 1 taken along line II-II' of FIG. 1.
Figure 3:
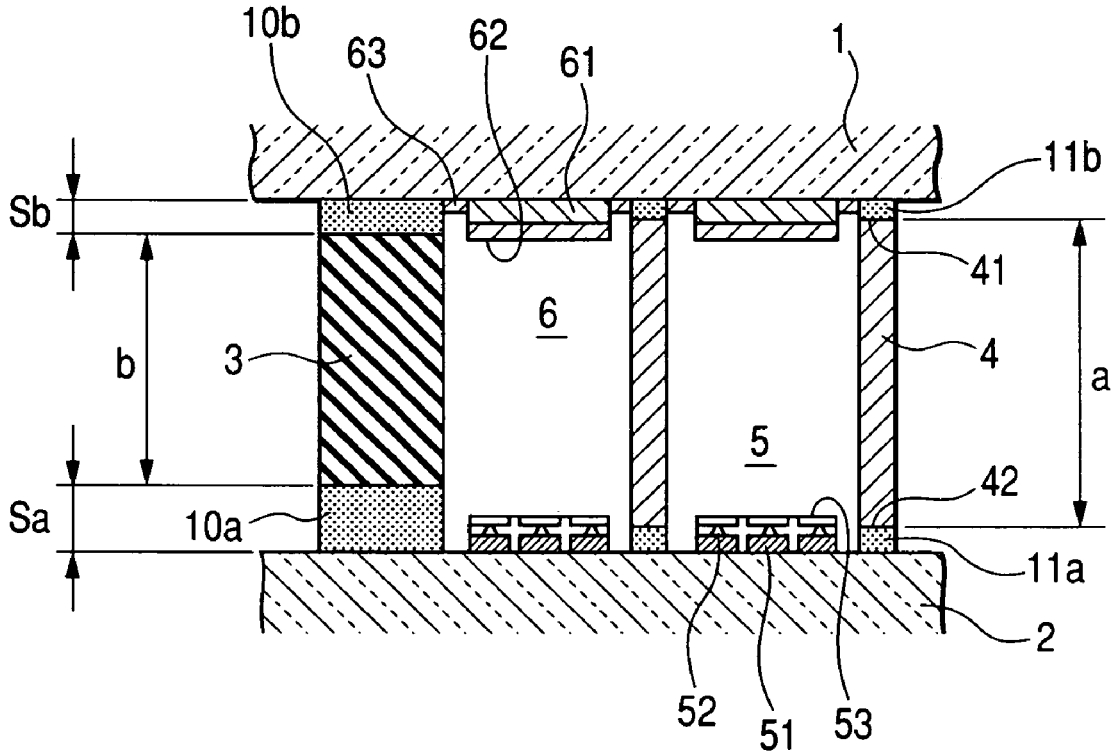
FIG. 3 is an enlarged cross-sectional view of an essential portion of the major portion of FIG. 2.

FIG. 1 is a plan view of a major portion of an electron-emission type display device in accordance with Embodiment 1 of the image display device of the present invention for explaining the rough configuration of the electron-emission type display device, FIG. 2 is an enlarged cross-sectional view of the major portion of the electron-emission type display device of FIG. 1 taken along line II-II' of FIG. 1, and FIG. 3 is an enlarged cross-sectional view of a major portion of the electron-emission type display device of FIG. 2. In FIGS. 1 to 3, reference numeral 1 denotes a front substrate comprised of light-transmissive glass plate, 2 is a rear substrate comprised of a light-transmissive glass plate as in the case of the front substrate 1, or comprised of a ceramic plate such as an alumina plate. The front and rear substrates 1, 2 are comprised of insulating substrates of about 3 mm in thickness, for example. Reference numeral 3 denotes a support frame which is a supporting member serving as an outer frame also, and which is a peripheral frame formed by assembling and bonding together elements obtained by shaping from glass or glass frit material and then cutting. The support frame 3 is sandwiched between and bonded to by using an adhesive, the peripheries of the front substrate 1 and the rear substrate 2, and maintains the spacing between the front and rear substrates 1, 2 at a desired dimension, about 3 mm, for example.

Reference numeral 4 denote plate-like spacers which serve as spacing-maintaining members. The spacers 4 are formed by cutting a thin glass plate or a thin ceramic plate such as an alumina plate of about 0.1 mm, for example, to pieces of about 3 mm in width (which corresponds to a height of the spacers 4). The plural spacers 4 are disposed to stand approximately upright on the major surfaces of the front substrate 1 and the rear substrate 2, to extend in one direction (an x direction), and to be arranged in another direction (a y direction). The plural spacers 4 maintain the spacing between the front substrate 1 and the rear substrate 2 at a desired value in cooperation with the support frame 3. In this Embodiment, as shown in FIG. 3, the spacers 4 and the support frame 3 have the relationship of a>b, where a is the height of the spacers 4, and the height of the support frame 3. Here, the tolerance of the height a of the spacers 4 is about ±100 μm, the tolerance of the height b of the support frame 3 is about ±10 μm, and the difference (b−a) is always in a range of −10 μm to −400 μm.

Reference numeral 5 denote electron-emissive elements, each of which comprises a corresponding one of cathode wirings 51, an electron source 52 and a control electrode 53. The electron-emissive elements 5 are arranged at specified intervals on the rear substrate 2. The plural cathode wirings 51 extend in one direction (an x direction) and are arranged in another direction (a y direction) on an inner surface of the rear surface 2. The plural cathode wirings 51 are divided into two groups, and ends of the plural cathode wirings 51 of one of the two groups are brought out of a hermetic sealing portion on one side of the rear substrate 2 so as to serve as leads 51*a* (see FIG. 1) for the cathode wirings 51 of the one group, and ends of the cathode wirings 51 of the other of the two groups are also brought out of the hermetic sealing portion on another side of the rear substrate 2 so as to serve as leads 51*a* (see FIG. 1) for the cathode wirings 51 of the other group. The cathode wirings 51 are formed by using evaporation, for example, or they are formed by thick-film printing a silver paste comprised of conductive silver particles of about 1 μm to about 5 μm in diameter mixed with an insulating low-melting glass, for example, and then firing the silver paste at about 600° C., for example.

The control electrodes 53 are disposed above the cathode wirings 51, and are insulated therefrom, and ends of the control electrodes 53 are brought out of the hermetic sealing portion on a remaining side of the rear substrate 2 so as to serve as leads 53*a* (see FIG. 1) for the control electrodes 53. The electron sources 52 are arranged at specified intervals on the cathode wirings 51, and are comprised of diamond films, graphite films, carbon nanotubes, or the like. By way of example, one way of fabricating the electron sources 52 comprises printing a paste of carbon nanotubes on a surface of the cathode wirings 51 formed by thick-film printing and firing, and then firing the carbon nanotube paste in vacuum at a temperature of about 590° C., for example.

Reference numeral 6 denote image-forming members, each of which is comprised of a phosphor film 61, a metal back film 62 deposited on the phosphor film 61 and a black matrix (BM) film 63. The image-forming members 6 are disposed on an inner surface of the front substrate 1.

Reference numeral 10*a* denotes a sealing member which seals together the rear substrate 2 and one end face of the support frame 3. For example, the sealing member 10*a* is formed of crystallized glass frit which comprises PbO of about 72 wt %, $B_2O_3$ of about 10 wt %, and ZnO of about 10 wt %. Reference numeral 10*b* denotes a sealing member which seals together the front substrate 1 and the other end face of the support frame 3. For example, the sealing member 10*b* is formed of noncrystalline glass frit which comprises PbO in a range of from 75 wt % to 80 wt %, $B_2O_3$ of about 10 wt %, and the remainder in a range of from about 10 wt % to about 15 wt %.

Further, as shown in FIG. 3, there is a relationship in thickness of Sa>Sb between the sealing member 10*a* for sealing together the rear substrate 2 and the support frame 3 and the sealing member 10*b* for sealing together the front substrate 1 and the support frame 3, where Sa is the sealing thickness of the sealing member 10*a*, and Sb is the sealing thickness of the sealing member 10*b*. In this way, the front substrate 1 and the rear substrate 2 are disposed on the top and bottom end faces of the support frame 3, respectively, so as to hermetically seal together the peripheries of the front substrate 1 and the rear substrate 2 stacked in a Z direction in FIG. 1. A region enclosed by the support frame 3, the front substrate 1 and the rear substrate 2 forms a display region 12 (see FIG. 1), and the interior of the display region 12 is maintained at a vacuum state. The hermetic sealing employing the sealing members 10*a* and 10*b* is performed in a nitrogen atmosphere, for example, at about 430° C., for example. Thereafter, the assembly is evacuated to vacuum while it is heated at about 350° C., and then is sealed off. In FIG. 1, the Z direction is taken as a direction perpendicular to the major surfaces of the stacked front and rear substrates 1, 2.

Reference numerals 11*a* and 11*b* denote fixing members which fix the spacers 4 and the front substrate 1 together, and the spacers 4 and the rear substrate 2 together, respectively. Of the fixing members 11*a* and 11*b*, the fixing members 11*a* for fixing together the front substrate 1 and the spacers 4 are formed of crystallized glass frit composed chiefly of $B_2O_3$, PbO and ZnO, for example, used as a material exhibiting a hysteresis in a viscosity vs. temperature characteristic, and fix together the rear substrate 2 and bottom end faces 42 of the spacers 4. The fixing members 11*b* are formed of noncrystalline glass frit composed chiefly of $SiO_2$, $B_2O_3$ and PbO, for example, and fix together the front substrate 1 and top end faces 41 of the spacers 4. Among the fixing members 11*a* and 11*b*, the fixing members 11*b* are formed of noncrystalline glass frit which exhibits hardness approximately equal to or lower than that of the spacers 4.

With the above configuration, electrons emitted from the electron sources 52 disposed on the cathode wirings 51 are controlled by and pass through electron-transmissive apertures in the control electrodes 53 supplied with grid voltages of about 100 V, travel toward the image-forming members supplied with an anode voltage of several kilovolts to about 10 kilovolts, pass through the metal back film 62 (the anode), and impinge upon the phosphor films 61 to cause them to emit light, thereby producing a desired display on a viewing screen. A unit pixel is formed in the vicinity of each of intersections of the cathode wirings 51 and the control electrodes 53 to form a matrix array, and the pixels arranged in a matrix fashion form the display region. Generally, a group formed of three unit pixels forms a color pixel comprised of red (R), green (G) and blue (B).

In the image display device of the above-explained configuration, since the height a of the spacers 4 is selected to be greater than the height b of the support frame 3, the spacing between the front substrate 1 and the rear substrate 2, is controlled to within a range approximately equal to that of the height a of the spacers 4, by selecting the sealing thickness Sa of the sealing member 10*a* for sealing together the support frame 3 and the rear substrate 2 to be greater than the sealing thickness Sb of the sealing member 10*b* for sealing together the support frame 3 and the front substrate 1. Further, the sealing member 10*a* having the greater sealing thickness Sa absorbs variations in the height of the support frame 3, and consequently, the front substrate 1 and the rear substrate 2 are sealed together with a spacing therebetween approximately equal to the height a of the spacers 4 of the close tolerance.

That is to say, alignment errors in sealing of the front and rear substrates 1, 2 are approximately proportional to the sealing thicknesses of the sealing members 10*a*, 10*b* sealing the bottom and top end faces of the support frame 3, respectively, and the thinner sealing member 10*b* is less susceptible to alignment errors in sealing. Therefore, by making the thicker sealing member 10*a* absorb the variations in the height of the support frame 3, the spacing between the front and bottom substrates 1, 2 is maintained at the height a of the spacers 4 with high accuracy.

The above configuration reduces concentration of stress in the display panel comprised of the front and rear substrates 1, 2 and the support frame 3, and consequently, can reduce possibility of occurrences of damage to the spacers 4 and others greatly. Further, since alignment errors in the vertical direction do not occur easily, the danger is eliminated that cracks or air leakage occurs in the hermetically sealed regions. In the above, a case has been explained where the height a of the spacers 4 is selected to be greater than the height b of the support frame 3. However, even in a case where the height a of the spacers 4 is selected to be equal to the height b of the support frame 3, the sealing member 10*a* having the greater sealing thickness Sa can absorb the variations in the height b of the support frame 3, and thereby the amount of the alignment errors in sealing of the front and rear substrates 1, 2 can be reduced.

Incidentally, in a case where the height a of the spacers 4 is selected to be smaller than the height b of the support frame 3, the spacers 4 cannot be bonded sufficiently between the front and rear substrates 1, 2 via the fixing members 11*b*, 11*a*, respectively, and consequently, the spacing between the front and rear substrates 1, 2 cannot be maintained at a desired value, and at the same time air leakage occurs easily in the regions where the support frame is hermetically sealed with the front and rear substrates 1, 2, respectively. Therefore it is preferable that the height a of the spacers 4 and the height b of the support frame 3 have the relationship of $a \geqq b$.

Figure 4:
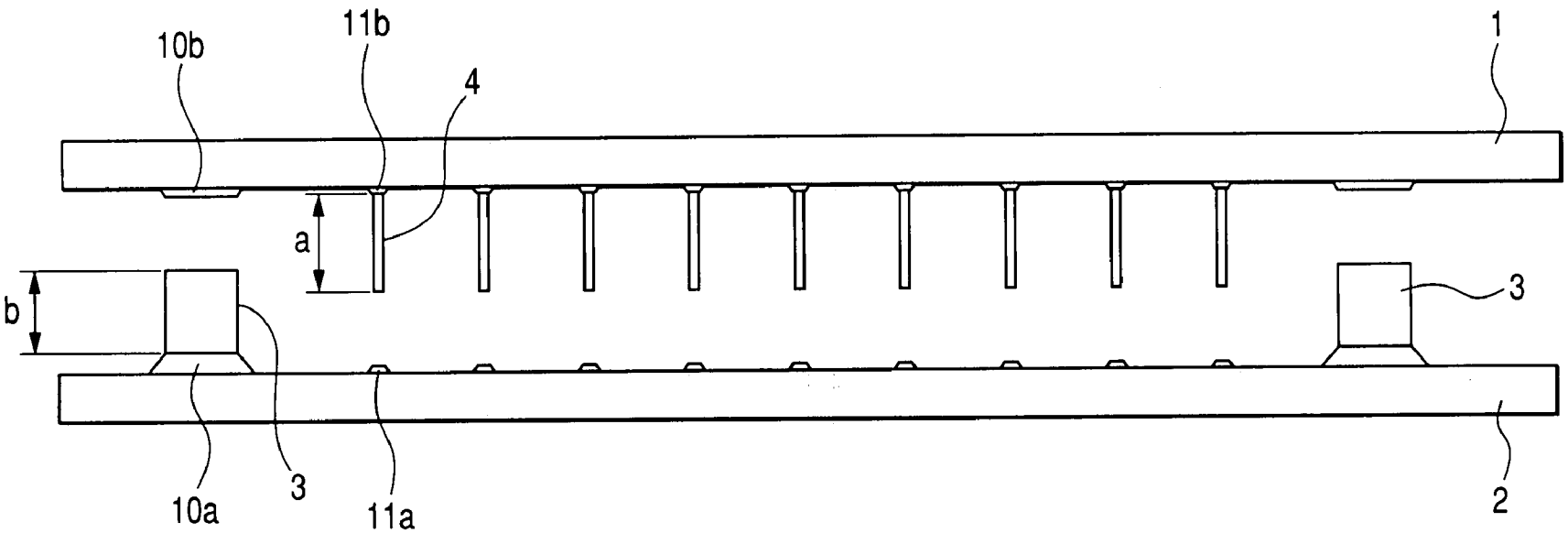
FIG. 4 is an exploded cross-sectional view of a major portion of a configuration of a combination of a front substrate and a rear substrate for the image display device in accordance with the present invention.

It is generally known that errors in the alignment of the front and rear substrates occurs in sealing of the front and rear substrates, and the amount of the alignment errors increases with increasing layer thickness of the sealing members. In view of this, in the present Embodiment, as shown in a cross-sectional view of a major portion of the present Embodiment of FIG. 4, initially the sealing member 10*b* and the fixing member 11*b* having the small sealing thickness Sb and comprised of noncrystalline glass frit are coated at specified positions of the front substrate 1, and then plural spacers 4 having the height a are bonded to the front substrate 1 by subjecting the sealing member 10*b* and the fixing member 11*b* to a preparatory firing with the plural spacers in contact with the fixing members 11*b*, to obtain an assembly in which the spacers 4 are suspended from the front substrate 1. Next, the sealing member 10*a* having the greater sealing thickness Sa and comprised of crystallized glass frit is coated on peripheral portions of the rear substrate 2, the fixing members 11*a* thinner than the sealing thickness Sa and comprised of noncrystalline glass frit, for example, are coated at specified positions on an inner area within the sealing member 10*a*, and then the fixing members 11*a* are subjected to a preparatory firing.

Next, the support frame 3 having the height b is placed on the sealing member 10*a* coated on the peripheral portions of the rear substrate 2, then the front substrate 1 is stacked on the rear substrate 2, and by performing a firing treatment the front and rear substrates 1, 2 are sealed together with the spacing therebetween being controlled to establish a value approximately equal to the height a of the spacers 4.

Figure 5:
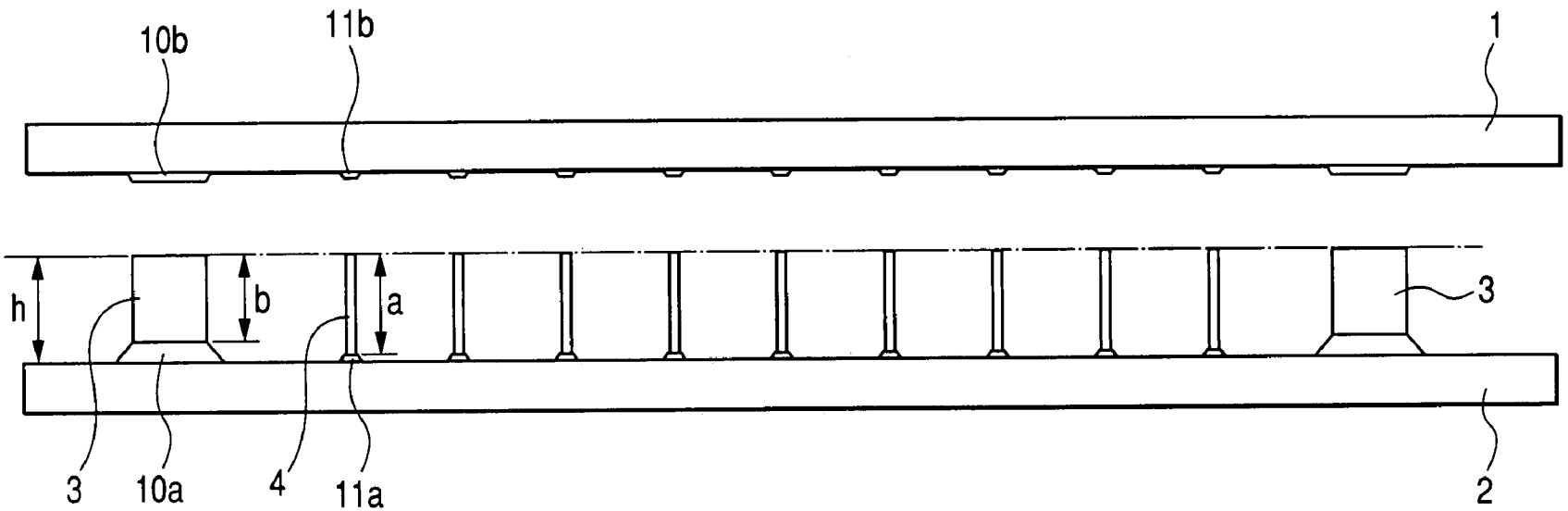
FIG. 5 is an exploded cross-sectional view of a major portion of a configuration of another combination of a front substrate and a rear substrate employed for the image display device in accordance with the present invention.

In the above explanation of the present Embodiment, the sealing member 10*a* and the fixing members 11*a* are coated on the rear substrate 2, the support frame 3 is bonded on the sealing member 10*a*, the sealing member 10*b* and the fixing members 11*b* are coated on the front substrate 1, then the front and rear substrates 1, 2 are assembled to oppose each other, and are bonded together. As an alternative method, as shown in a cross-sectional view of a major portion of the present Embodiment of FIG. 5, initially the fixing members 11*a* are coated on the rear substrate 2, the plural spacers 4 are bonded on the fixing members 11*a*, and then the front and rear substrates 1, 2 can be assembled and bonded together to oppose each other. In this case also, the front and rear substrates 1, 2 are sealed together with the variations in the height h of the support frame 3 being controlled to within the tolerances (within ±10 μm) of the height a of the spacers 4. Further, it is needless to say that in this case the support frame 3 may be bonded to the front substrate 1 in advance.

Further, although in the above explanation of the present Embodiment, the sealing members 10*a*, 10*b* have been explained as crystallized glass frit and noncrystalline glass frit, it is needless to say that both of the sealing members 10*a* and 10*b* may be formed of the same material.

The following will explain some concrete examples regarding the relationship between the height a of the spacers 4 and the height b of the support frame 3 in FIG. 3.

The following are assumed:

The thickness of each of the sealing members 10*a*, 10*b* for sealing together the front and rear substrates 1, 2 via the support frame 3 is in a range of from 10 μm to 200 μm; and The thickness of each of the fixing members 11*a*, 11*b* for bonding the spacers 4 to at least one of the front and rear substrates 1, 2 is in a range of from 5 μm to 50 μm.

However, in a case where the spacers 4 are bonded to only one of the front and rear substrates 1, 2, only the corresponding ones of the fixing members 11*a*, 11*b* are used.

A first concrete example where a difference (a−b) between the height a of the spacers 4 and the height b of the support frame 3 is selected to be in a range of from 10 μm to 400 μm:

The sealing members 10*a*, 10*b* are comprised of glass frit, and the thickness of each of the sealing members 10*a*, 10*b* is selected to be about 200 μm to secure a sufficiently reliable hermetic sealing; and The tolerance of the height of the spacers 4 is selected to be ±10 μm.

A second concrete example where a difference (a−b) between the height a of the spacers 4 and the height b of the support frame 3 is selected to be in a range of from 10 μm to 300 μm:

The sealing members 10*a*, 10*b* are comprised of glass frit, and the thickness of only one of the sealing members 10*a* and 10*b* is selected to be about 100 μm in the first concrete example to reduce the amount of alignment errors in sealing of the front and rear substrates.

A third concrete example regarding a relationship between the sealing thickness Sa of the sealing member 10*a* and the sealing thickness Sb of the sealing member 10*b*:

A concrete example where the difference (Sa−Sb) in the sealing thickness is selected to be in a range of from 10 μm to 190 μm:

The maximum sealing thickness difference 190 μm is derived from a difference (200 μm−10 μm) between the maximum coating thickness and the minimum coating thicknesses of glass frit required for securing the sealing function and securing workability, and the minimum sealing thickness difference 10 μm is derived from a difference (20 μm−10 μm) between the sealing thickness Sa required for absorbing the tolerance (±10 μm) of the height a of the spacers 4 and the minimum value 10 μm of the sealing thickness Sb.

Embodiment 2

In this Embodiment of the image display device in accordance with the present invention, in a case where the sealing thickness Sa of the sealing member 10*a* is selected to be greater than the sealing thickness Sb of the sealing member 10*b*, the material of the sealing member 10*a* for bonding the support frame 3 to the rear substrate 2 is made different from that of the sealing member 10*b* for bonding the support frame 3 to the front substrate 1. FIG. 12 tabulates some examples of combinations of sealing members comprised of materials different from each other.

As an example of the silicone adhesives in FIG. 12, there is a silicone resin adhesive comprising at least phenylheptamethylcyclotetrasiloxane and 2,6-cis-diphenylhexamethylcyclotetrasiloxane, which is an adhesive capable of maintaining hermetic sealing performance at high temperatures, proposed by Japanese Patent Application Laid-Open Publication No. 2,004-182,959.

The constituent material of the sealing member 10*a* on the rear substrate 2 side is made different from that of the sealing member 10*b* on the front substrate 1 side, and the sealing member 10*b* of the sealing thickness Sb exhibits viscosity different from that of the sealing member 10*a* of the sealing thickness Sa at high temperatures, and therefore at the time of sealing, the sealing member 10*b* melts predominantly and performs the sealing. That is to say, the sealing thickness Sb is predominantly collapsed, and thereby the amount of alignment errors can be reduced.

Further, the composition of glass frit of the fixing members 11*a* on the rear substrate 2 side may be made different from that of glass frit of the fixing members 11*b* on the front substrate 1 side. For example, the hardness of the fixing members on one of the front substrate 1 side and the rear substrate 2 is selected to be approximately equal to or lower than the hardness of the spacers 4. Since the tolerance (variations) of the height a of the spacers 4 is close, the concentration of the vacuum stress on the panel comprised of the front substrate 1, the rear substrate 2 and the support frame 3 is reduced, and the vacuum stress is dispersed approximately uniformly. Further, in a case where the hardness of both the fixing members 11*a* and 11*b* is approximately equal to that of the spacers 4, the concentration of the vacuum stress on the panel is further reduced, and thereby damage to the spacers 4 is reduced.

Embodiment 3

Figure 6:
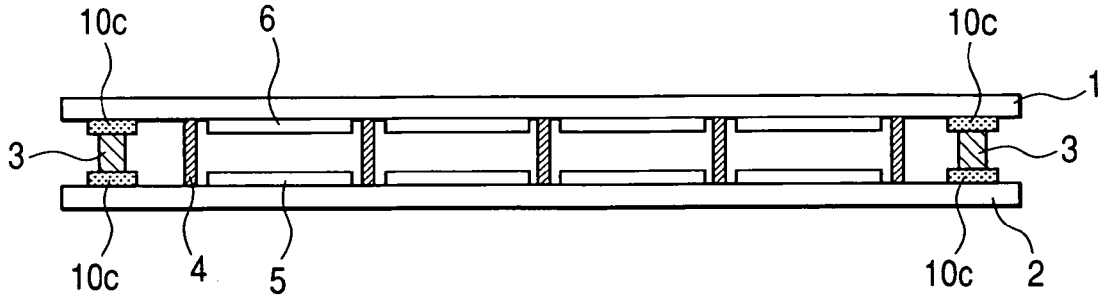
FIG. 6 is a schematic plan view illustrating a configuration of a major portion of Embodiment 3 of the image display device in accordance with the present invention.

FIG. 6 is a cross-sectional view of a major portion of an electron-emission type display device in accordance with Embodiment 3 of the image display device of the present invention for explaining the rough configuration of the electron-emission type display device, the same reference numerals as utilized in the above-explained figures designate corresponding portions in FIG. 6, and the explanation of those portions is omitted.

Omitted in FIG. 6 are the details of the electron-emissive elements 5 formed on the inner surface of the rear substrate 2 and the image-forming members 6 formed on the inner surface of the front surface 1. Since the spacers 4 are usually fabricated by cutting a thin glass plate or a thin ceramic plate such as an alumina plate into small-piece components, the spacers 4 can be fabricated with their height a being held to close tolerances. As shown in an enlarged cross-sectional view of the major portion of the image display device, if the spacing between the front and rear substrates 1, 2 is to be established by the height b of the support frame 3, since the support frame 3 needs to perform the hermetic sealing function also, there arises a problem in that the cost of fabrication of the support frame 3 increases greatly for achieving the close tolerances of the height b completely around the periphery of the support frame 3. Further, since the sealing members 10*c* are required to absorb the variations in the height b of the support frame 3 and to perform the hermetic sealing function, it is difficult for the sealing members 10*c* to also control the spacing between the electron-emissive elements 5 and the image-forming members 6 at the time of melting and bonding the fixing members 11*c*.

In view of the above, the display panel is fabricated by selecting the dimensional difference (a−b) to be 0.10 mm, for example, where a is the height of the spacers 4 for maintaining the spacing between the front and rear substrates 1, 2 at a desired value, and b is the height of the support frame 3. Here, the tolerance of the height b of the support frame 3 is ±0.10 mm (±100 μm) as described above, and therefore the sealing is performed by using the sealing members 10*c* having the thickness Sc of about 0.1 mm on each end of the support frame 3. On the other hand, the spacers 4 are bonded to the front and rear substrates 1, 2 by using the electrically conductive fixing members 11*c* having the thickness Sd of about 0.03 mm on both of top and bottom ends of the spacers 4.

The thickness Sc of the sealing members 10*c* for the support frame 3 is coated to a thickness of about 0.2 mm before assembling of the display panel, and in the completed display panel, the thickness Sc of the sealing members 10*c* becomes 0.1 mm±0.08 mm due to the variations in the thickness b of the support frame 3. In this case, the thickness Sd of the fixing members 11*c* for the spacers 4 was the order of 0.04 mm±0.01 mm before assembling, and in the completed display panel, it became 0.03 mm.

Here, the spacers 4 are fabricated with the tolerance of its height a being about 10 μm, the tolerance of the height a of the spacers 4 is preferably about 5 μm or less, and the tolerance of the height a is selected to be equal to or closer than about one fifth of the height b of the support frame 3. Here, the spacing between the electron-emissive elements 5 formed on the inner surface of the front substrate 1 and the image-forming members 6 formed on the inner surface of the rear substrate 2 is in a range of from 2 mm to 15 mm, and the spacers 4 are formed to be from 5 mm to 1,000 mm long in a direction of the short sides of the display screen.

Aligning of the rear substrate 2 having the electron-emissive elements 5 formed on its inner surface and the front substrate 1 having the image-forming members 6 on its inner surface is performed while the rear substrate 2 and the front substrate 1 are floated not to contact the support frame 3 and the spacers 4 by using an aligning mechanism, and thereafter the rear substrate 2 and the front substrate 1 are brought gradually closer to each other, and are bonded preliminarily to each other when they are placed in contact with each other.

Bonding of the spacers 4 sandwiched between the front and rear substrates 1, 2 which are pressed against each other, via the fixing members 11*c* is performed at 450° C.±30° C., for example, in a nitrogen atmosphere, for example, and thereafter hermetic sealing of the support frame 3 via the sealing members 10*c* is performed similarly at 430%±30%, for example, in a nitrogen atmosphere, then the panel is evacuated while it is heated at 350%±30%, for example, and then is hermetically sealed off to complete the panel. In the above process, both ends of the spacers 4 stick into the fixing members 11*c*, and thereby the front substrate 1 and the rear substrate 2 are bonded together. Electrical contacts to the spacers 4 are established by sintering and contacting of the electrically conductive particles contained in the fixing members 11*c*, and thereby the fixing members 11*c* exhibited the resistance equal to or lower than 10 gigaohm·cm.

Figure 7:
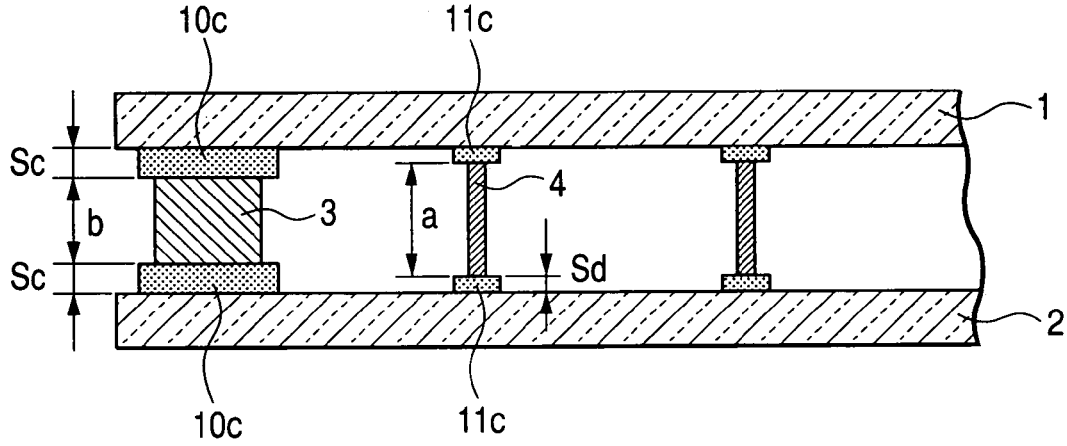
FIG. 7 is an enlarged cross-sectional view of an essential portion of the major portion of the image display device of FIG. 6.
Figure 8:
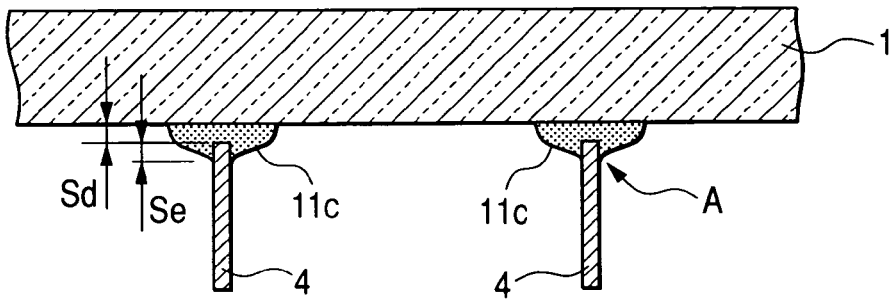
FIG. 8 is an enlarged cross-sectional view of an essential portion of the major portion of the image display device FIG. 6.
Figure 9:
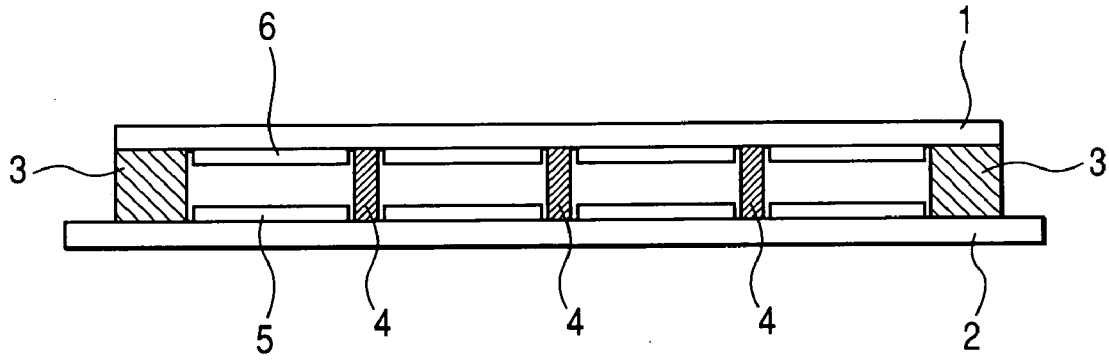
FIG. 9 is a cross-sectional view of a major portion of a basic configuration of a conventional image display device.
Figure 10:
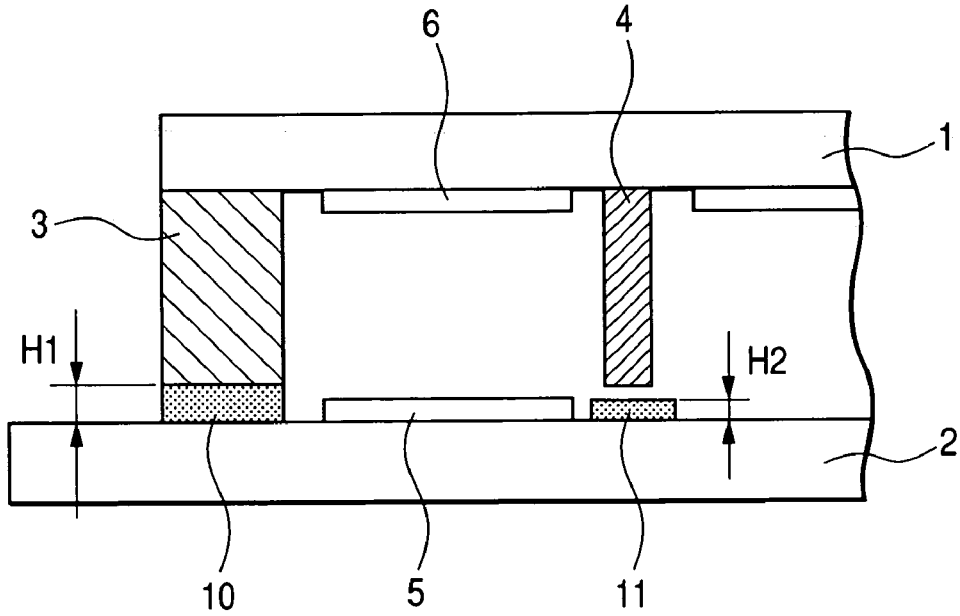
FIG. 10 is an enlarged cross-sectional view of a major portion of the conventional image display device of FIG. 9 for explaining a problem with the conventional image display device.
Figure 11:
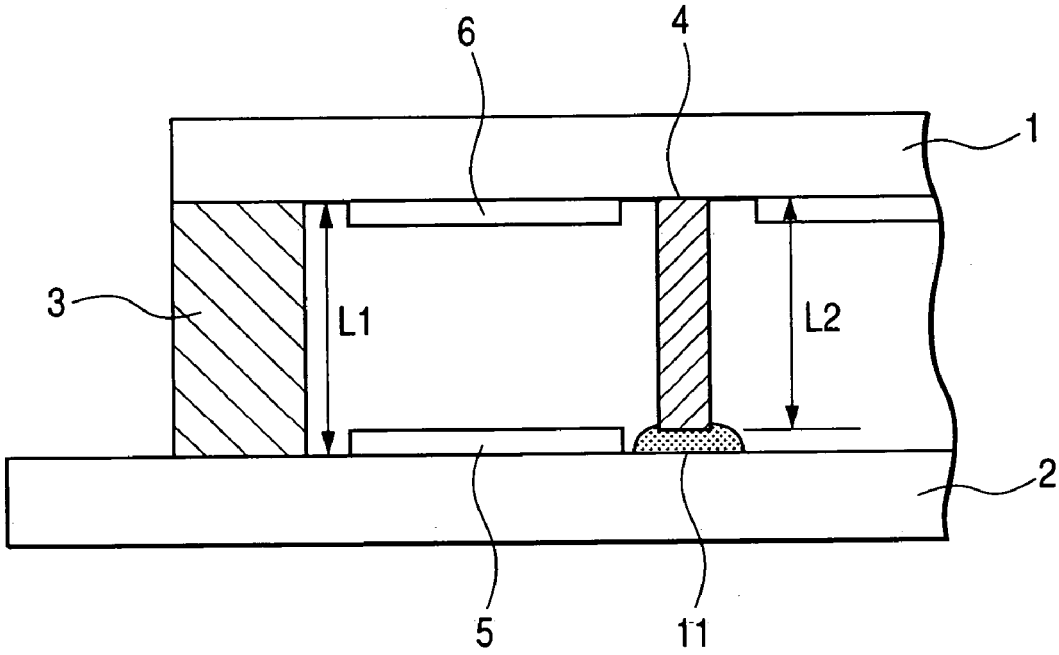
FIG. 11 is an enlarged cross-sectional view of a major portion of the conventional image display device of FIG. 9 for explaining a problem with the conventional image display device.

In the assembled display panel, the sealing members 10*c*, the front substrate 1 and the rear substrate 2 are in intimate contact with each other at their interfaces, and good wetted states are confirmed. Similarly, as shown in an enlarged cross-sectional view of FIG. 8 depicting their major portions, top ends of the fixing members 11*c* for fixing the spacers 4 are wetted sufficiently as indicated by an arrow A, it was confirmed that the top ends of the fixing members 11*c* are embedded to a depth of about 0.02 mm in the fixing members 11*c*. Also in the case of the fixing members 11*c* for bonding of the bottom ends of the spacers 4 to the rear substrate 2 shown in FIG. 7, it was confirmed that the bottom ends of the spacers 4 are embedded into the fixing members 11*c* in the same way as explained above.

In the above Embodiment, the fixing thickness (the thickness in the completed display panel) Sd of the fixing members 11*c* was selected to be about 0.03 mm which fix the top and bottom ends of the spacers 4 to the front and rear surfaces 1, 2, respectively. If the fixing thickness Sd of the fixing members 11*c* is selected to be about 5 μm or less, the local concentration of stresses easily occurs in the display panel due to unevenness in the surfaces of the spacers 4 and fillers or the like contained in the fixing members 11*c*, and they are a factor for causing cracks.

Further, in the present Embodiment, the depth Se (see FIG. 8) to which one end of the spacer 4 is embedded in the fixing members 11*c* was explained as about 0.02 mm. If the depth Se is selected to be excessively small, the spacers 4 fall down easily. If the thickness of the fixing members 11*c* is selected to be excessively great, high potential charges are accumulated irregularly and influence trajectories of electrons. Therefore it was preferable to select the depth Se to be in a range of 20 μm±15 μm.

In the above-described Embodiment, the sealing thickness Sc of the sealing members 10*c* after the sealing operation was explained as 0.10 mm±0.08 mm. If the sealing thickness Sc of the sealing members 10*c* is selected to be about 20 μm or less, in some cases the hermetic sealing is not sufficiently achieved due to granular materials such as fillers contained in the sealing members 10*c*, a sufficient degree of vacuum cannot be maintained, and air leakage often results.

On the other hand, if the sealing thickness Sc of the sealing members 10*c* is selected to be about 180 μm or more, there is an increasing tendency that the sealing members 10*c* melts (softens) during baking of the display panel for the evacuation of the display panel, and that the sealing members 10*c* is sucked into the interior of the display panel since the interior of the display panel is evacuated to vacuum. Further, in this case, bubbles are contained easily within the sealing members 10*c*, if occurrences of bubbles are repeated during the manufacturing steps, the degree of vacuum is degraded. Therefore it is preferable to select the thickness Sc of the sealing members 10*c* as measured after the sealing operation to be in a range of from 20 μm to 180 μm.

Since the spacers 4 are formed into small-piece components, in the above configuration the spacers 4 are capable of dispersing atmospheric pressure to the entirety of the display panel uniformly, the safety against the force of atmospheric pressure is improved. Further, since the spacers 4 can be fabricated by scribing grooves in a thin glass plate or a plate comprised of ceramic such as alumina before breaking into plural small-piece components, and thereafter breaking into plural small-piece components, the spacers 4 can be realized at a low cost with hardly increasing the manufacturing cost.

Further, in the above-described configuration, since the electrically conductive particles are contained in the fixing members 11*c*, electrical contact to the spacers 4 is ensured, the effect of preventing accumulation of charges on the spacers 4 is obtained, and the effect of suppressing of occurrence of spark is also expected at the same time.

Further, although in the above-described Embodiments, a case was explained where the relationship of (a−b)=0.10 mm, where a is the height of the spacers 4 for maintaining the spacing between the front and rear substrates 1, 2 at a desired value, and b is the height of the support frame 3, it was especially preferable to satisfy the relationship of (a−b) =0.15 mm±0.10 mm in view of the variations in the heights of the support frame 3 and the spacers 4 and the variations in the thicknesses of the sealing members 10*c* and the fixing members 11*c*.

Further, although in the above-described Embodiments, as shown in FIG. 1, plural spacers 4 are aligned with those in adjacent columns, the present invention is not limited to this configuration, and it is needless to say that even if the spacers 4 can be arranged in various fashions such as a staggered fashion, the above-described advantages can be obtained.

Further, although in the above-described Embodiments, as shown in FIG. 2, the top end faces of the spacers 4 are bonded to the front substrate 1 via the fixing members 11*b*, and the bottom end faces of the spacers 4 are bonded to the rear substrate 2 via the fixing members 11*a*, even in a case where the fixing members 11*b* or the fixing members 11*a* are omitted, the above-explained advantages of the present invention are obtained.

Further, although in the above-described Embodiments, the image display devices have been explained as FEDs employing the front substrate having phosphors and a black matrix on its inner surface, and having an anode behind the phosphors and the black matrix, the present invention is not limited to the above configuration, it is needless to say that even in a case where the present invention is applied to a plasma display device (PDP) and flat panel type display devices employing a metal-insulator-metal type electron sources, the above-described advantages of the present invention are obtained.

What is claimed is:

1. An image display device comprising:

a front substrate having an anode and phosphors on an inner surface thereof;

a rear substrate having a plurality of electron sources on an inner surface thereof, and disposed to oppose said front substrate with a specified spacing between said front and rear substrates;

a support member which is sandwiched between said front and rear substrates, surrounds a display region formed between said front and rear substrates, and maintains said specified spacing; and a plurality of spacing-maintaining members which are sandwiched between said front and rear substrates in said display region, and are fixed at at least one of end faces of each of said plurality of spacing-maintaining members to a corresponding one of said front and rear substrates via a fixing member, wherein one end face of said support member is hermetically sealed to said rear substrate via a first sealing member, and another end face of said support member is hermetically sealed to said front substrate via a second sealing member; and wherein a height of said spacing-maintaining members is greater than a height of said support member.

2. An image display device according to claim 1, wherein a difference between the height of said spacing-maintaining members and the height of said support member is in a range of from 10 μm to 400 μm.

3. An image display device according to claim 2, wherein a difference between the height of said spacing-maintaining members and the height of said support member is in a range of from 10 μm to 300 μm.

4. An image display device according to claim 1, wherein a thickness of said first sealing member is different from a thickness of said second sealing member.

5. An image display device according to claim 4, wherein the thickness of said first sealing member is greater than the thickness of said second sealing member.

6. An image display device according to claim 5, wherein the thickness of said first sealing member is greater by a value in a range of from 10 μm to 190 μm than the thickness of said second sealing member.

7. An image display device according to claim 1, wherein said first and second sealing members differ in material composition from each other so that said first and second sealing members differ from each other in viscosity vs. temperature characteristics.

8. An image display device according to claim 1, wherein said first sealing member is comprised of crystallized glass frit, and said second sealing member is comprised of noncrystalline glass frit.

9. An image display device according to claim 1, wherein said first sealing member is comprised of first noncrystalline glass frit, and said second sealing member is comprised of second noncrystalline glass frit having a softening point lower than a softening point of said first noncrystalline glass frit.

10. An image display device according to claim 1, wherein said first sealing member is comprised of noncrystalline glass frit, and said second sealing member is comprised of silicone adhesive.

11. An imaged is play device according to claim 10, wherein said silicone adhesive is a silicone resin comprising at least phenylheptamethylcyclotetrasiloxane and 2,6-cis-diphenylhexamethylcyclotetrasiloxane.

12. An image display device according to claim 1, wherein said first sealing member is comprised of crystallized glass frit, and said second sealing member is comprised of silicone adhesive.

13. An image display device according to claim 12, wherein said silicone adhesive is a silicone resin comprising at least phenylheptamethylcyclotetrasiloxane and 2,6-cis-diphenylhexamethylcyclotetrasiloxane.

14. An image display device according to claim 1, wherein one end face of each of said plurality of spacing-maintaining members is fixed to said rear substrate via said fixing member of a first kind, another end face of each of said plurality of spacing-maintaining members is fixed to said front substrate via said fixing member of a second kind, and said fixing member of said first kind and said fixing member of said second kind differ in material composition from each other so that said fixing members of said first and second kinds differ from each other in viscosity vs. temperature characteristics.

* * * * *